US011676776B2

(12) United States Patent
Nalawade et al.

(10) Patent No.: US 11,676,776 B2
(45) Date of Patent: Jun. 13, 2023

(54) FINGER SAFE COVER FOR A TERMINAL OF AN ELECTRICAL SWITCHING DEVICE

(71) Applicant: Appleton GRP LLC, Rosemont, IL (US)

(72) Inventors: Swapnil S. Nalawade, Maharashtra (IN); Andrey Shashin, Chicago, IL (US)

(73) Assignee: Appleton Grp LLC, Rosemont, IL (US)

( * ) Notice: Subject to any disclaimer, the term of this patent is extended or adjusted under 35 U.S.C. 154(b) by 57 days.

(21) Appl. No.: 17/344,611

(22) Filed: Jun. 10, 2021

(65) Prior Publication Data

US 2022/0059300 A1 Feb. 24, 2022

(30) Foreign Application Priority Data

Jun. 12, 2020 (IN) ..... 202021024790

(51) Int. Cl.
*H01H 9/02* (2006.01)

(52) U.S. Cl.
CPC ..... *H01H 9/02* (2013.01); *H01H 2223/044* (2013.01)

(58) Field of Classification Search
CPC .... H01H 9/02; H01H 2223/044; H01H 13/04; H01H 19/04; H02G 3/16; H02G 3/14; H02G 3/08
USPC ..... 200/293, 296, 303, 304; 220/4.02; 174/60
See application file for complete search history.

(56) References Cited

U.S. PATENT DOCUMENTS 9,742,161 B2 8/2017 Sharp
9,779,890 B2 10/2017 Parro et al.
(Continued)

FOREIGN PATENT DOCUMENTS

CN 209328811 8/2019
EP 0 992 047 1/2003
(Continued)

OTHER PUBLICATIONS

First Examination Report (FER) of Indian Patent Application No. 202021024790 dated Dec. 30, 2021, pp. 1-6.

*Primary Examiner* — Edwin A. Leon
*Assistant Examiner* — Iman Malakooti
(74) *Attorney, Agent, or Firm* — McDonnell Boehnen Hulbert & Berghoff LLP

(57) ABSTRACT

The present disclosure relates to finger-safe requirements for breaker modules from electrical panel boards and envisages a finger safe cover 100*a* for a terminal of an electrical switching device 50. The finger safe cover comprises a cover body 110*a* with an expandable aperture section 120*a*. The aperture section 120*a* has an annulus 122*a* having a primary aperture 124*a* and a coupling section 126*a* surrounding the annulus 122*a*. The primary aperture 124*a* allows a thinner conducting cable 52 to pass therethrough. The coupling section 126*a* couples the annulus 122*a* with the cover body 110*a*. The aperture section 120*a* defines a secondary aperture 128*a* when the annulus 122*a* is detached from the cover body 110*a* by breaking the coupling section 126*a*, to allow to pass therethrough a thicker conducting cable 54. The cover 100*a* passes the IPXXB test, eliminates the need of safety accessories and is easy to install.

18 Claims, 12 Drawing Sheets

(56) References Cited

U.S. PATENT DOCUMENTS

| | | | | |
|---|---|---|---|---|
| 2004/0238198 | A1* | 12/2004 | Shotey | H02G 3/081 174/53 |
| 2005/0092506 | A1* | 5/2005 | Hull | H02G 3/085 174/50 |
| 2005/0109597 | A1* | 5/2005 | Etscheidt | H01H 9/0264 200/293 |
| 2014/0090863 | A1* | 4/2014 | Korcz | H02G 3/083 174/50 |
| 2016/0247652 | A1* | 8/2016 | Devine | H01H 71/128 |

FOREIGN PATENT DOCUMENTS

| | | |
|---|---|---|
| JP | H087741 | 1/1996 |
| JP | 2000067728 | 3/2000 |

* cited by examiner

FINGER SAFE COVER FOR A TERMINAL OF AN ELECTRICAL SWITCHING DEVICE

RELATED APPLICATION

This application claims priority to Indian Patent Application No. 202021024790 entitled "A Finger Safe Cover For a Terminal of an Electrical Switching Device" filed on Jun. 12, 2020, the contents of which are incorporated herein in their entirety.

FIELD

The present disclosure relates to sealed electrical enclosures with circuit breakers/switches/fuses for use in hazardous locations inside an electrical panelboard. Particularly, the present disclosure relates to finger-safe requirements for breaker modules from electrical panel boards.

DEFINITION

IPXXB protection level: High voltage sources are enclosed in barriers that prevent direct human contact with the high voltage sources. The 'ingress protection (IP)' levels are defined as per size of the test tools that represent the smallest object that should not contact with the high voltage source. IPXXB protection prevents incidental contact of the hazardous part (i.e., the high voltage source) with a human finger. An IPXXB probe is a jointed test finger of 12 mm diameter and 80 mm length.

BACKGROUND

The background information herein below relates to the present disclosure but is not necessarily prior art.

The users of an electrical panelboard such as electricians and maintenance personnel often interact with panelboards for wiring or maintenance routines. These personnel often tend to handle the panelboard while the circuit breaker terminals are electrically live. The personnel need to always stay alert to ensure that they do not touch the live terminals.

Most of the existing arrangements are not electrically mistake-proof. There is a possibility of the user touching the live parts. If the user touches the live terminal components, there is a hazard of electrocution.

While certain terminals from existing arrangements of circuit breakers have the provision to meet finger safe requirements, they are designed to suit only a single specification of a conducting cable. Circuit breakers are often required to connect with conducting cables which vary in size.

Certain other arrangements involve use of accessories to meet finger safe requirements, which adds to the cost as well as requires the user to be more alert and use the accessory to prevent any hazard.

Thus, there is a need of a finger safe arrangement for a circuit breaker terminal, which ameliorates the aforementioned issues.

OBJECTS

Some of the objects of the present disclosure, which at least one embodiment herein satisfies, are as follows:

A primary object of the present disclosure is to provide a finger safe arrangement for an electrical switching device.

Another object of the present disclosure is to provide a finger safe arrangement for an electrical switching device, which passes the standard requirements for ingress protection.

Yet another object of the present disclosure is to provide a finger safe arrangement for an electrical switching device, which accommodates a plurality of sizes of conducting cables.

Still another object of the present disclosure is to provide a finger safe arrangement for an electrical switching device, which eliminates the need of safety accessories.

Yet another object of the present disclosure is to provide a finger safe arrangement for an electrical switching device, which is easy to install.

Other objects and advantages of the present disclosure will be more apparent from the following description, which is not intended to limit the scope of the present disclosure.

SUMMARY

The present disclosure envisages a finger safe cover for a terminal of an electrical switching device. The finger safe cover comprises a cover body with an expandable aperture section. The expandable aperture section is located on the cover body to allow a conducting cable to pass therethrough and make electrical contact with the terminal.

In an embodiment, the expandable aperture section has an annulus defining a primary aperture and a frangible coupling section defined in the operative outer periphery of the annulus. The primary aperture is configured to allow a first conducting cable of a first diameter to pass therethrough. The coupling section is configured to couple the annulus to the cover body. The aperture section defines a secondary aperture that is configured to be revealed when the annulus is detached from the cover body by breaking the coupling section. The secondary aperture is configured to allow a second conducting cable of a second diameter that is greater than that of the conducting cable of the first diameter to pass therethrough. In an embodiment, the coupling section is defined by ribs connecting the primary aperture with the secondary aperture. The ribs are separated by slits. In another embodiment, the coupling section is defined by serrations provided along the operative outer perimeter of the primary aperture. In an embodiment, annuli are concentrically cascaded with couplings sections defined between adjacent annuli.

In another embodiment, the expandable aperture section has an annular window defining a primary aperture and having coupling tabs in the operative outer periphery of the annular window, and a secondary aperture. The primary aperture is configured to allow a first conducting cable of a first diameter to pass therethrough. The coupling tabs are configured to facilitate mounting of the annular window on the cover body. The secondary aperture is configured to be revealed when the annular window is removed from the cover body. The secondary aperture is configured to allow to pass therethrough a second conducting cable of a second diameter that is greater than that of the first conducting cable. In a preferred embodiment, the coupling tabs are configured to snap-fit onto the rim of the secondary aperture. In an embodiment, annular windows are configured to be mounted in a concentrically cascading manner.

Typically, the cover body of the finger safe cover has a front plate, a bottom plate and two side plates, wherein the expandable aperture section is located on the front plate and the fitment of the finger safe cover on the housing of the electrical switching device is facilitated through the side plates and the bottom plate.

In an embodiment, the finger safe cover has a pair of ears configured to allow snap-fitment of the finger safe cover on the housing of the electrical switching device.

The finger safe cover is adapted to be fitted between the terminal and an explosion-proof enclosure.

Preferably, the finger safe cover is made of an insulating transparent material.

BRIEF DESCRIPTION OF THE ACCOMPANYING DRAWING

A finger safe cover, of the present disclosure, will now be described with the help of the accompanying drawing, in which:

FIGS. 11A and 11B illustrate rear and front isometric views of an annular window of FIG. 11A.

Figures 12A, 12B:
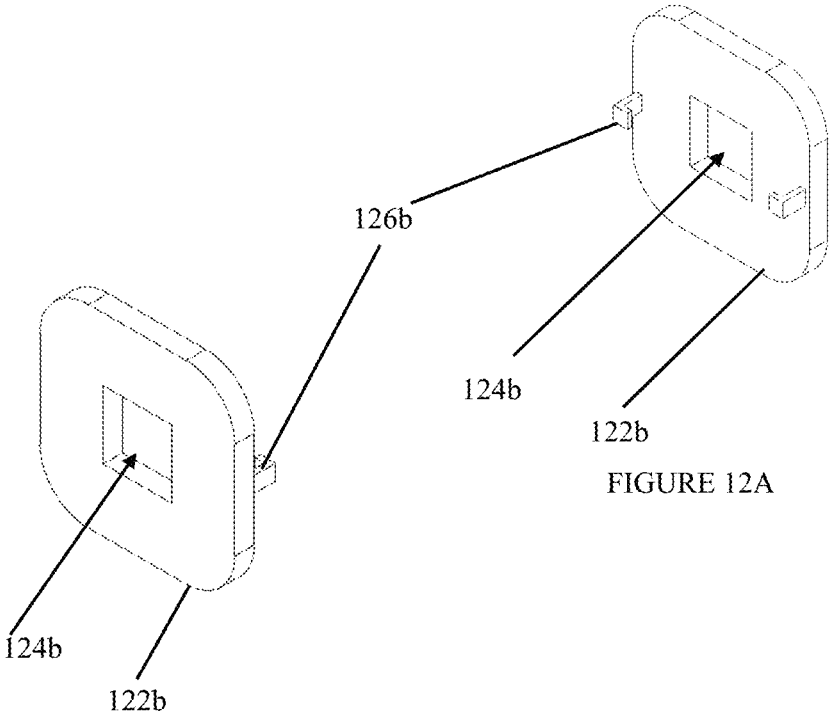

FIGS. 12A and 12B provide perspective views of annular window 122*b*.

LIST OF REFERENCE NUMERALS

50 electrical switching device
52 first conducting cable
54 second conducting cable
100*a*, 100*b* finger safe cover
110*a*, 110*b* cover body
120*a*, 120*b* expandable aperture section
122*a* annulus
122*b* annular window
124*a*, 124*b* primary aperture
126*a* coupling section
126*b* coupling tabs
128*a*, 128*b* secondary aperture
130*a* rib
132*a* slit
140*a*, 140*b* ear
200 IPXXB probe

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an" and "the" may be intended to include the plural forms as well, unless the context clearly suggests otherwise. The terms "comprises", "comprising", "including" and "having" are open ended transitional phrases and therefore specify the presence of stated features, elements, modules, units and/or components, but do not forbid the presence or addition of one or more other features, elements, components, and/or groups thereof.

The terms first, second, third, etc., should not be construed to limit the scope of the present disclosure as the aforementioned terms may be only used to distinguish one element, component or section from another component or section. Terms such as first, second, third etc., when used herein do not imply a specific sequence or order unless clearly suggested by the present disclosure.

Personnel handling an electrical panelboard while the circuit breaker terminals are electrically live always need to stay alert to ensure that they do not touch the live terminals. Certain existing arrangements of covering the terminals are not fool-proof and thus pose risk for the users. While certain terminals from existing arrangements of circuit breakers have the provision to meet finger safe requirements, they are designed to suit only a single specification of a conducting cable. Circuit breakers are often required to connect with a range of conducting cables which vary in size. Certain other arrangements also use accessories to meet finger safe requirements, which is an additional cost as well as a hassle.

There is a need of a finger safe arrangement for an electrical switching device which passes the standard requirements for ingress protection (IPXXB test), accommodates a plurality of sizes of conducting cables, eliminates the need of safety accessories and is easy to install.

The present disclosure envisages a finger safe cover for a terminal of an electrical switching device. The finger safe cover comprises a cover body with an expandable aperture section. The expandable aperture section is located on the cover body to allow a conducting cable to pass therethrough and make electrical contact with the terminal. Typically, the cover body of the finger safe cover has a front plate, a bottom plate and two side plates, wherein the expandable aperture section is located on the front plate and the fitment of the finger safe cover on the housing of the electrical switching device is facilitated through the side plates and the bottom plate, e.g., by providing holes for threaded fasteners.

Figure 1:
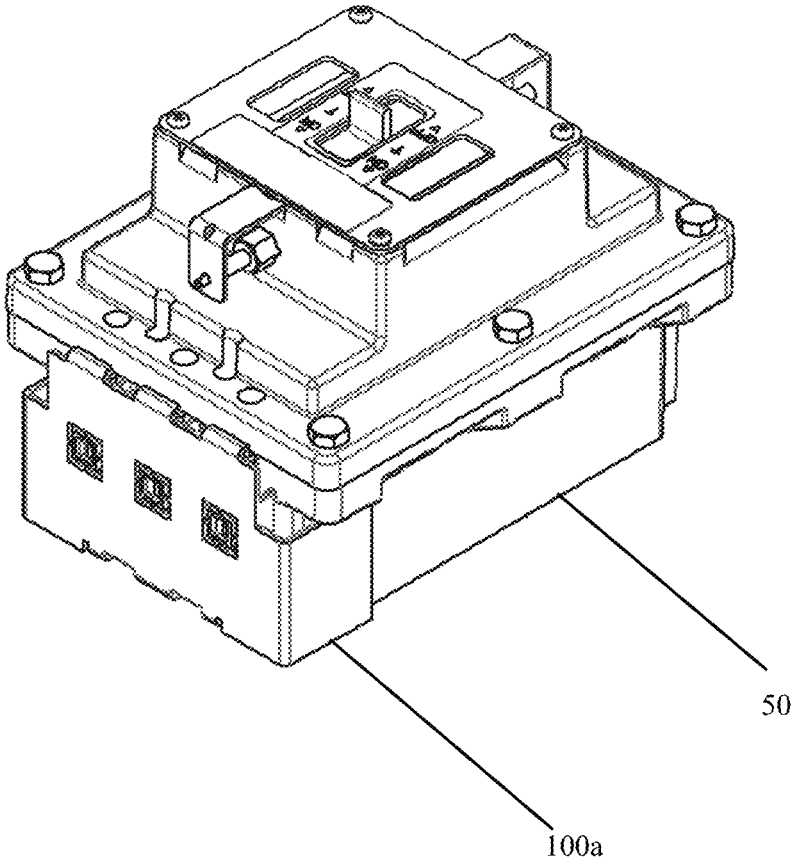
FIG. 1 illustrates an electrical switching device with the finger safe cover of the present disclosure.
Figure 2A:
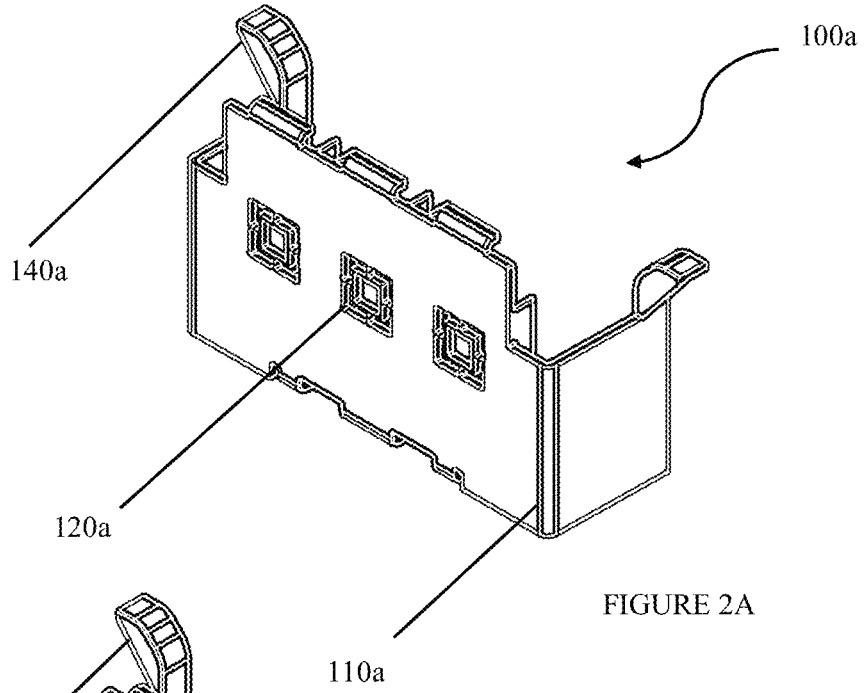
FIGS. 2A and 2B illustrate a finger safe cover according to an embodiment of the present disclosure, before and after expansion, respectively.
Figure 2B:
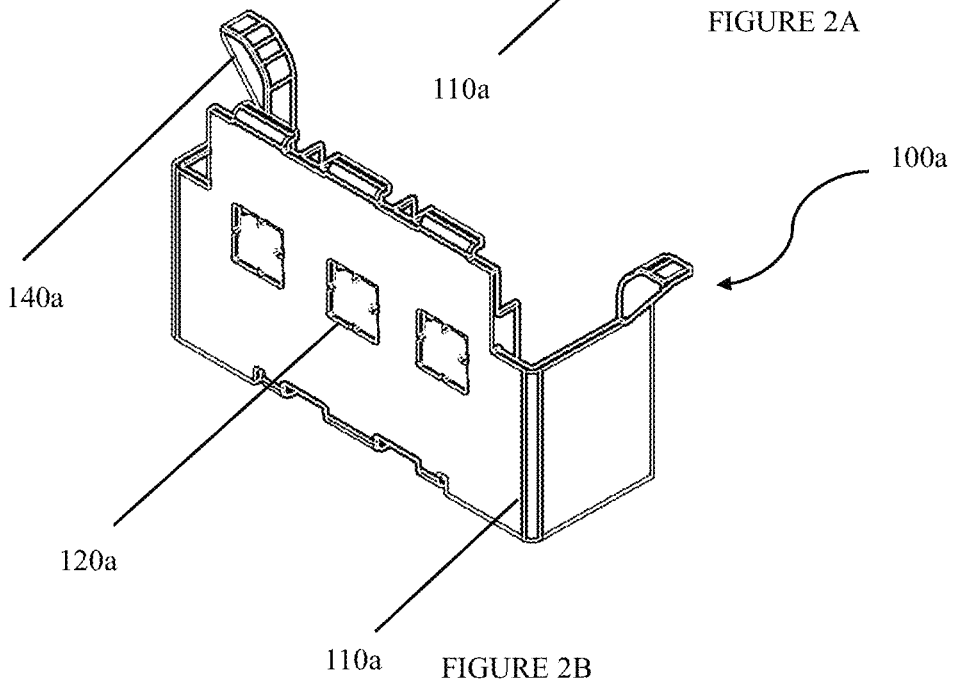
Figure 3A:
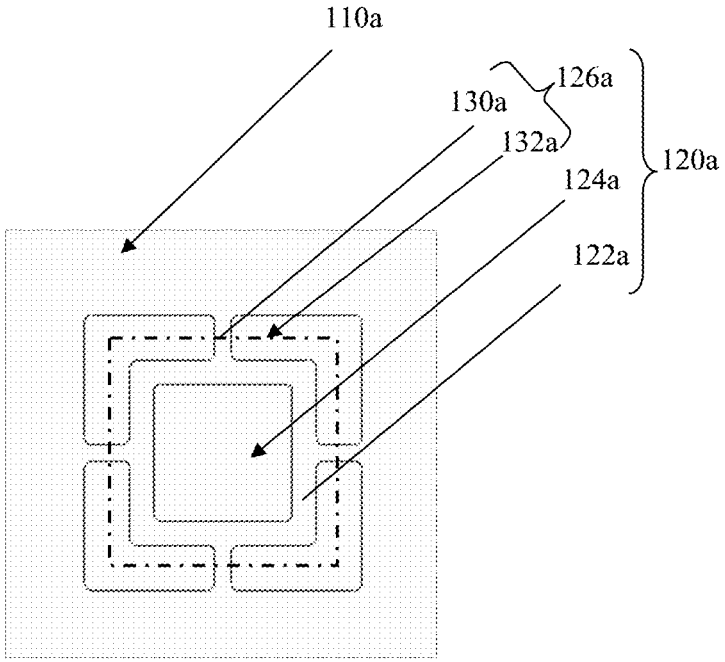
FIGS. 3A and 3B illustrate expandable aperture sections of the finger safe covers of FIGS. 2A and 2B respectively.
Figure 3B:
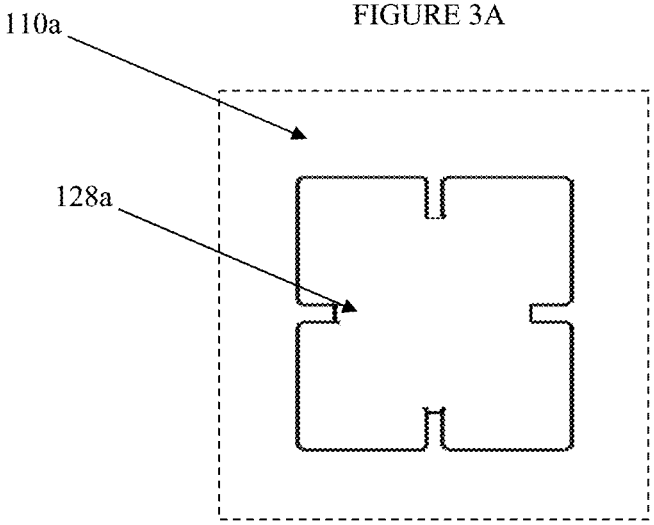
Figure 4A:
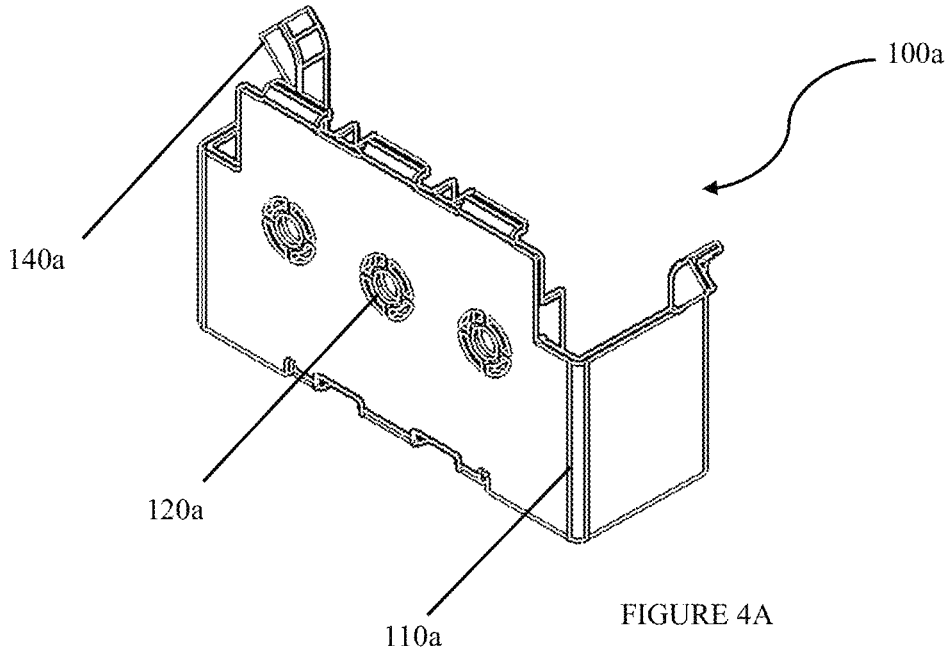
FIGS. 4A and 4B illustrate a finger safe cover according to another embodiment of the present disclosure, before and after expansion, respectively.
Figure 4B:
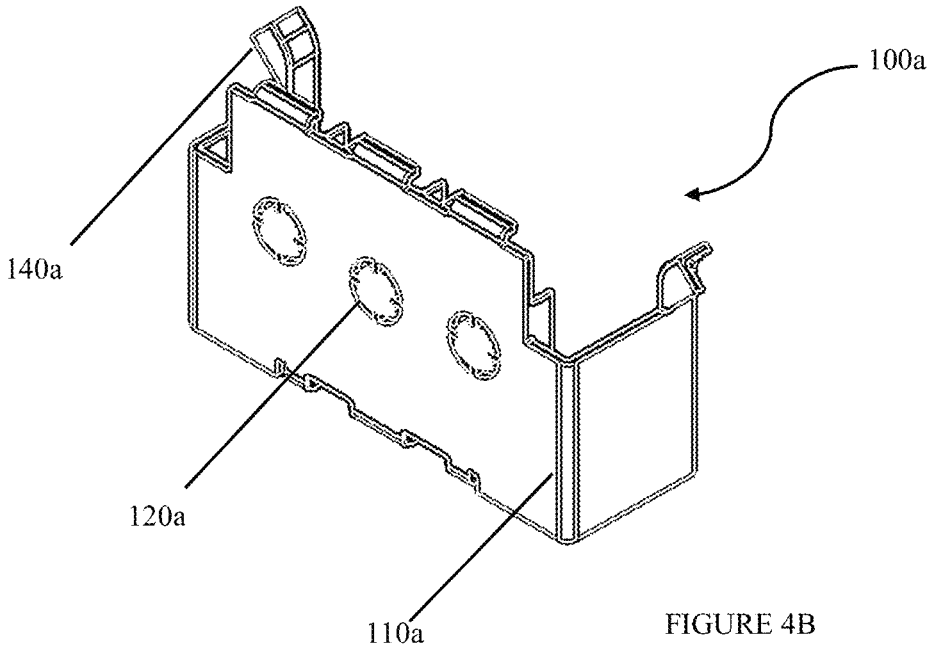
Figure 5A:
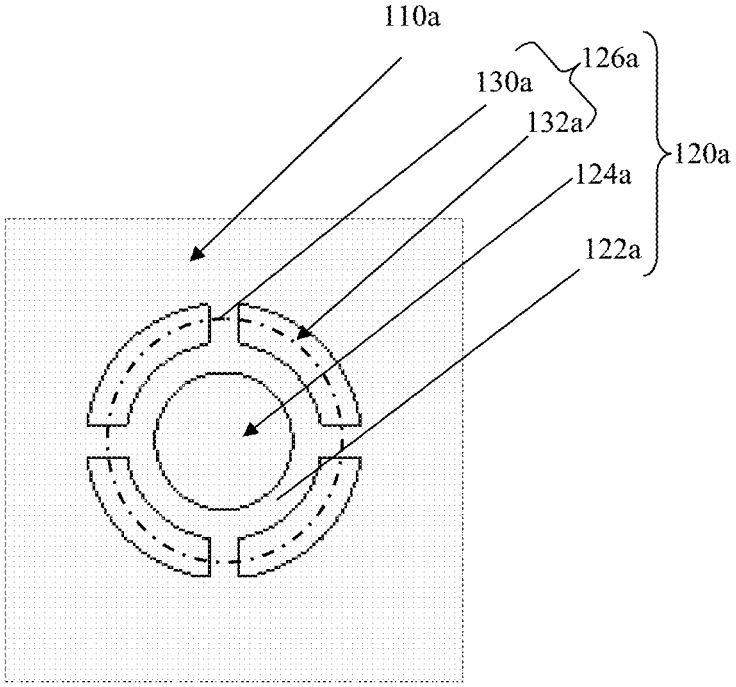
FIGS. 5A and 5B illustrate expandable aperture sections of the finger safe covers of FIGS. 4A and 4B respectively.
Figure 5B:
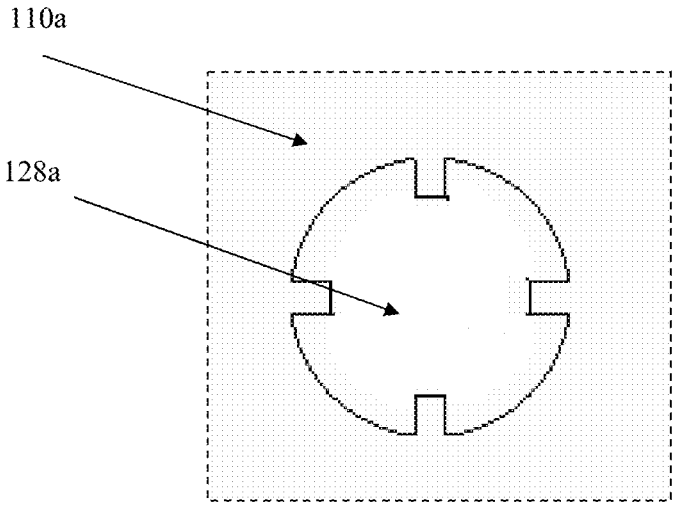
Figure 6A:
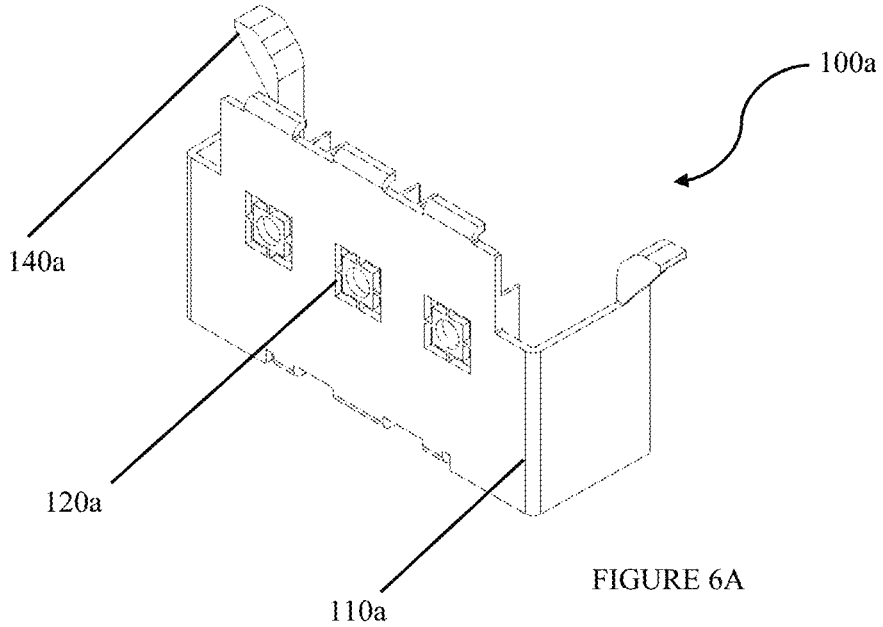
FIGS. 6A and 6B illustrate a finger safe cover according to yet another embodiment of the present disclosure, before and after expansion, respectively.
Figure 6B:
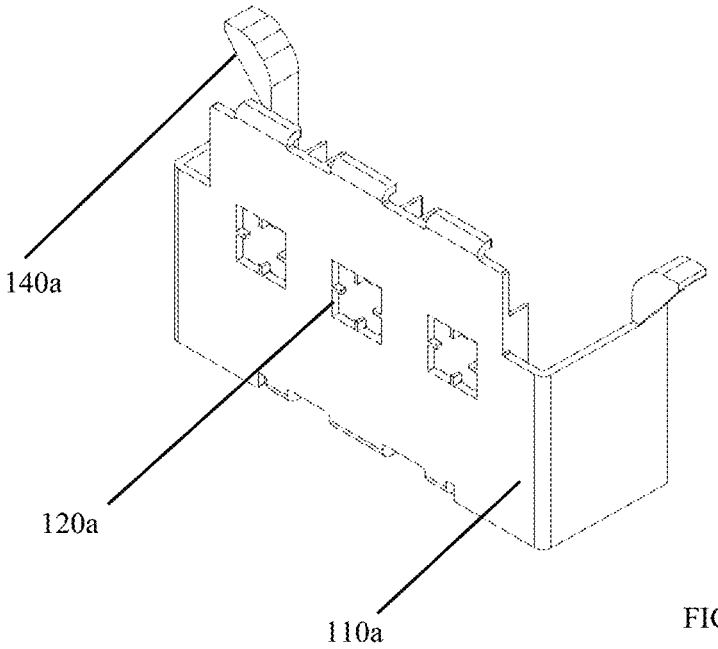
Figure 7A:
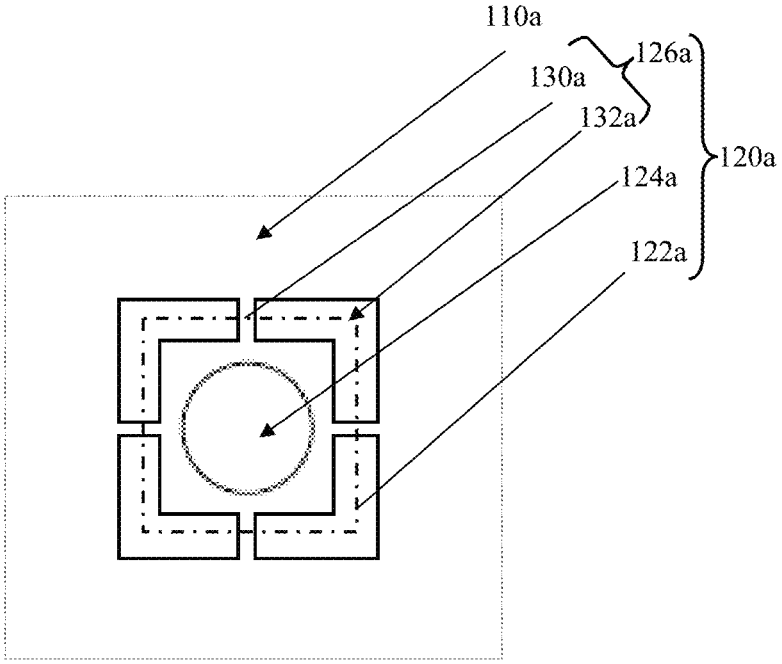
FIGS. 7A and 7B illustrate expandable aperture sections of the finger safe covers of FIGS. 6A and 6B respectively.
Figure 7B:
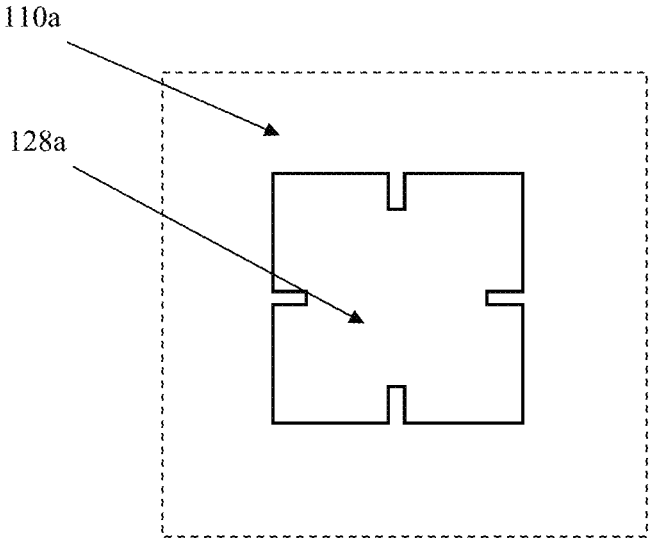
Figure 8A:
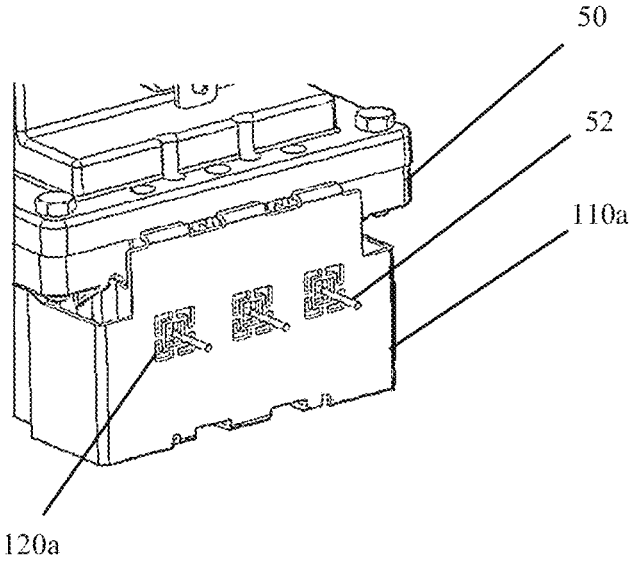
FIGS. 8A and 8B illustrate the finger safe covers of FIGS. 2A and 2B respectively with the conducting cables of corresponding sizes passing through the respective expandable aperture sections.
Figure 8B:
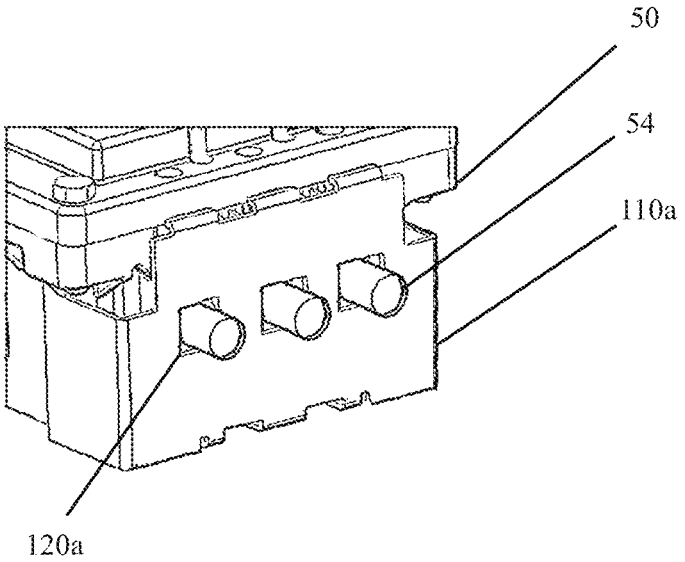

One embodiment of a finger safe cover 100*a* of the present disclosure is illustrated with the help of FIGS. 1-9B. FIG. 1 shows an electrical switching device 50, that is a circuit breaker, whose terminals are covered with the finger safe cover 100*a*. The expandable aperture section 120*a* of the finger safe cover 100*a* has an annulus 122*a*, that defines a primary aperture 124*a*, and a frangible coupling section 126*a* in the operative outer periphery of the annulus 122*a*. FIGS. 2A, 4A, and 6A show various embodiments of the finger safe cover 100*a* before expansion. FIGS. 3A, 5A, and 7A show details of the expandable aperture section 120*a* of FIGS. 2A, 4A, and 6A respectively. The primary aperture 124*a* allows a first conducting cable 52 of a first diameter to pass therethrough, as shown in FIG. 8A. The coupling section 126*a* couples the annulus 122*a* with the cover body 110*a*. The aperture section 120*a* defines a secondary aperture 128*a* that is configured to be revealed when the annulus 122*a* is detached from the cover body 110*a* by breaking the coupling section 126*a*. FIGS. 2B, 4B, 6B show various embodiments of the finger safe cover 100*a* after expansion. FIGS. 3B, 5B, and 7B show details of the expandable aperture section 120*a* of FIGS. 2B, 4B, 6B respectively. The secondary aperture 128*a* is configured to allow a second conducting cable 54 of a second diameter that is greater than that of the first conducting cable 52 of the first diameter to pass therethrough. In an embodiment, the coupling section 126*a* is defined by ribs 130*a* connecting the primary aperture 124*a* with the secondary aperture 128*a*. The ribs 130*a* are separated by slits 132*a*.

In another embodiment, the coupling section 126*a* is defined by serrations provided along the operative outer perimeter of the primary aperture 124*a*. The annulus 122*a* can be broken from the cover body 110*a* by using a simple tool such as a screwdriver. In an embodiment, annuli are concentrically cascaded in the cover body 110*a* with couplings sections defined between adjacent annuli. Thus, a range of conducting cables of different diameters can be passed through the finger safe cover while maintaining safety.

In another embodiment that is illustrated through FIGS. 10A-12B, the expandable aperture section 120*b* has an annular window 122*b* defining a primary aperture 124*b* and having coupling tabs 126*b* in the operative outer periphery of the annular window 122*b*, and a secondary aperture 128*b*. The primary aperture 124*b* is configured to allow a first conducting cable 52 of a first diameter to pass therethrough. The coupling tabs 126*b*, shown in FIGS. 12A-12B, facilitate coupling of the annular window 122*b* with the cover body 110*b*. The secondary aperture 128*b* is configured to be revealed when the annular window 122*b* is removed from the cover body 110*b*, as shown in FIGS. 10B and 11B. The secondary aperture 128*b* is configured to allow, to pass therethrough, a second conducting cable 54 of a second diameter that is greater than that of the first conducting cable 52. In a preferred embodiment, the coupling tabs 126*b* are configured to snap-fit onto the rim of the secondary aperture 128*b*. The annular window 122*b* can be removed from the cover body 110*b*, for allowing a thicker cable such as cable 54 to pass therethrough, using fingers or by using a tool such as a screwdriver. Moreover, the annular window 122*b* can be manually replaced back in place to again, by aligning over the secondary aperture 128*b* and pressing in, reduce the size of the aperture back to that for only allowing a thinner cable such as cable 52 to pass therethrough. In an embodiment, annular windows are configured to be mounted in the cover body 110*b* in a concentrically cascading manner. Thus, a range of conducting cables of different diameters can be passed through the finger safe cover while maintaining safety.

Figure 10A:
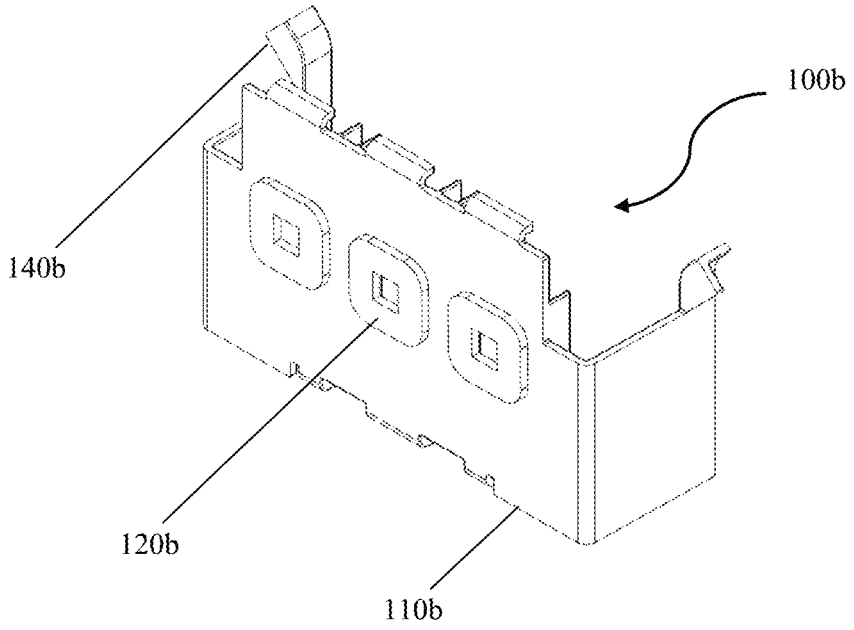
FIGS. 10A and 10B illustrate a finger safe cover according to still another embodiment of the present disclosure, before and after expansion, respectively.
Figure 10B:
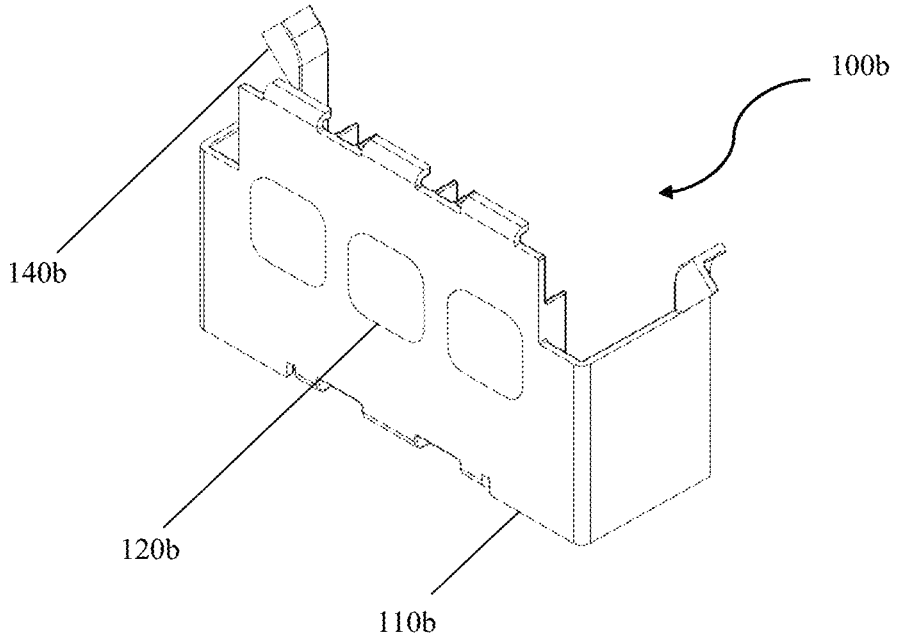
Figure 11A:
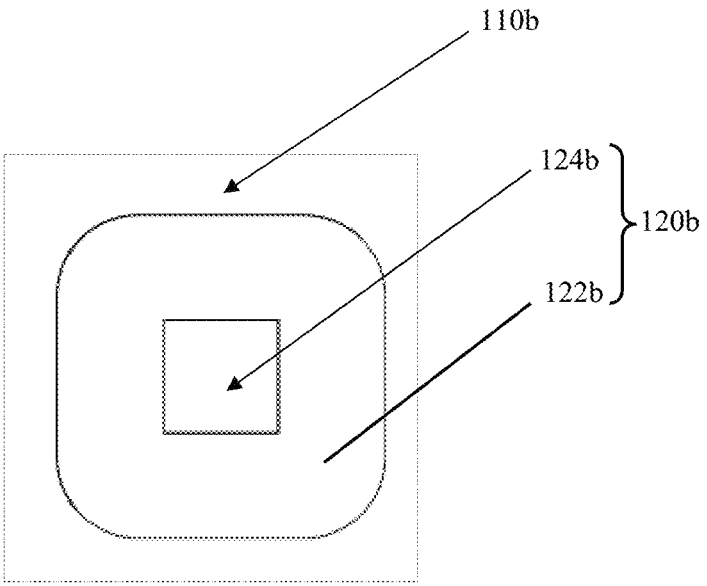
FIGS. 11A and 11B illustrate expandable aperture sections of the finger safe covers of FIGS. 10A and 10B respectively.
Figure 11B:
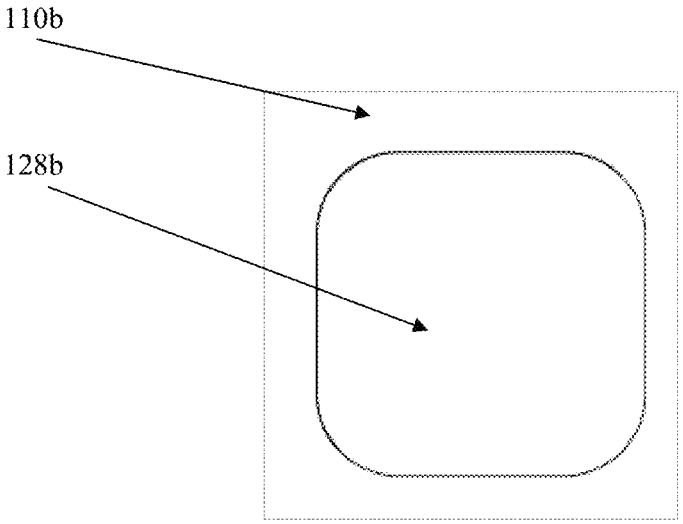

As shown in FIGS. 2A, 2B, 4A, 4B, 6A, 6B, the finger safe cover 100*a*, of the first embodiment, has a pair of ears 140*a* configured to allow snap-fitment of the finger safe cover 100*a* on the housing of the electrical switching device 50. Thus, the finger safe cover 100*a* can be manually fitted in position by sliding vertically upwards and removed by pulling vertically downwards. The elasticity of the ears 140*a* firmly locks the finger safe cover 100*a* in place unless removed using an external force. The same feature has been incorporated in the finger safe cover 100*b*, of the second embodiment, as shown in FIGS. 10A, 10B.

The finger safe cover of the present disclosure is adapted to be fitted between the terminal and an explosion-proof enclosure (not illustrated in Figures). In an embodiment, the finger safe cover is adapted to snugly fit between ribs of an F-frame circuit breaker and the bosses at the bottom of the housing.

Preferably, the finger safe cover is made of an insulating transparent material that makes it not only safe but convenient for placement and handling, by allowing visibility of the inner conducting cables and any open wires.

Figure 9A:
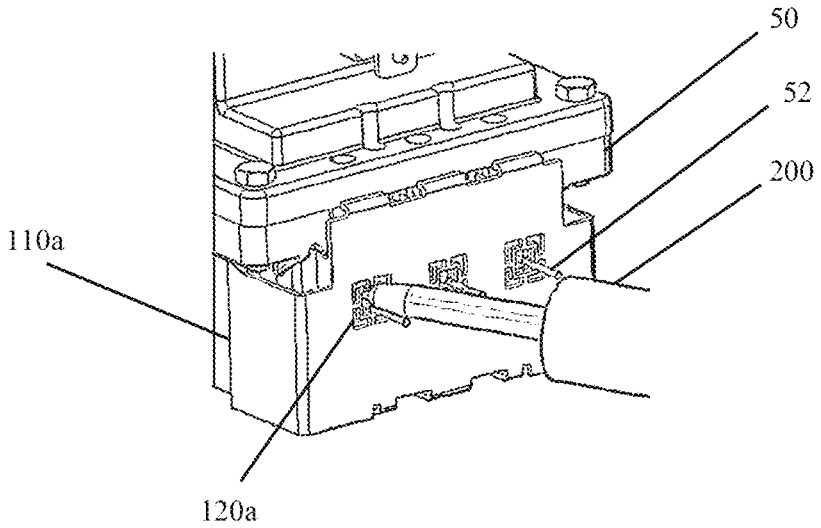
FIGS. 9A and 9B illustrate finger probe test performed on the expandable aperture sections of FIGS. 8A and 8B respectively.
Figure 9B:
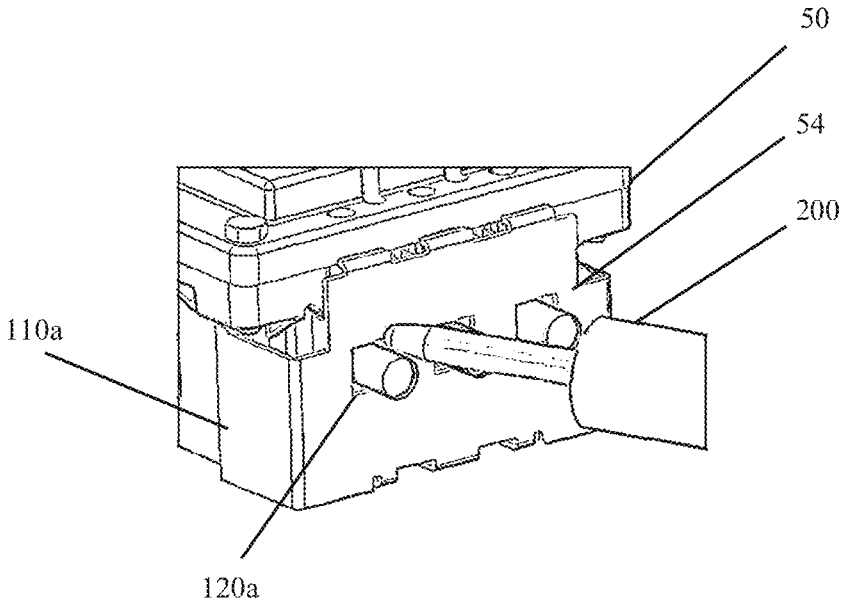

FIGS. 9A-9B illustrate a finger probe test, i.e., the IPXXB test, performed on the finger safe cover 100*a* using an IPXXB probe 200. As shown in FIG. 9A, the IPXXB test is performed when the aperture section 120*a* of the finger safe cover 100*a* is in the non-expanded state, i.e., when the first conducting cables 52 of smaller diameters are passing through the primary apertures 124*a*. The IPXXB probe 200 does not ingress and contact the terminals covered by the finger safe cover 100*a*. Further, as shown in FIG. 9B, the IPXXB test is performed when the aperture section 120*a* of the finger safe cover 100*a* is in the expanded state, i.e., when the second conducting cables 54 of greater diameters are passing through the secondary apertures 128*a*. Even in this case, the IPXXB probe 200 does not ingress and contact the terminals covered by the finger safe cover 100*a*. Thus, the finger safe cover 100*a* of the first embodiment passes the IPXXB test. Similarly, although an illustration is not provided for brevity, it will be obvious that the finger safe cover 120*b* of the second embodiment also passes the IPXXB test.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCEMENTS

The present disclosure described herein above has several technical advantages including, but not limited to, the realization of a finger safe cover for an electrical switching device, that:

- passes the standard requirements for ingress protection;
- which accommodates a plurality of sizes of conducting cables;
- eliminates the need of safety accessories; and
- is easy to install.

The embodiments herein and the various features and advantageous details thereof are explained with reference to the non-limiting embodiments in the following description.

Descriptions of well-known components and processing techniques are omitted so as to not unnecessarily obscure the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation

We claim:

1. A finger safe cover (100*a*) for a terminal of an electrical switching component (50), said finger safe cover (100*a*) comprising a cover body (110*a*) with an expandable aperture section (120*a*), said expandable aperture section (120*a*) located on said cover body (110*a*) to allow a conducting cable to pass therethrough and make electrical contact with said terminal, said expandable aperture section (120*a*) having:

a removable aperture section (122*a*) having a primary aperture surrounded entirely by the removable aperture section (124*a*) that allows a first conducting cable (52) having a first diameter to pass through the primary aperture (124*a*) of the removable aperture section (122*a*);

a frangible coupling section (126*a*) extending from an outer periphery of said removable aperture section (122*a*), said frangible coupling section (126*a*) configured to couple said removable aperture section (122*a*) to said cover body (110*a*);

a secondary aperture (128*a*) positioned in the cover body (110*a*) configured to be revealed when said removable aperture section (122*a*) is detached and removed from said cover body (110*a*) by breaking said frangible coupling section (126*a*), said secondary aperture (128*a*) configured to allow a second conducting cable (54) having a second diameter that is greater than the first diameter of the first conducting cable (52) to pass therethrough;

wherein the removable aperture section has a ring-like shape.

2. The finger safe cover (100*a*) as claimed in claim 1, wherein said frangible coupling section (126*a*) includes a plurality of ribs (130*a*) connecting said removable aperture section (122*a*) to said cover body (110*a*).

3. The finger safe cover (100*a*) as claimed in claim 1, wherein said frangible coupling section (126*a*) includes serrations provided along said outer periphery of said removable aperture section (122*a*).

4. A finger safe cover (100*b*) for a terminal of an electrical switching component (50), said finger safe cover (100*b*) comprising a cover body (110*b*) with a removable aperture section (120*b*) having a primary aperture (124*b*) surrounded entirely by the removable aperture section, said removable aperture section (120*b*) located on said cover body (110*b*) to allow a conducting cable to pass through the primary aperture (124*b*) of the removable aperture section (120*b*) and make electrical contact with said terminal, said removable aperture section (120*b*) having coupling tabs (126*b*) positioned on the removable aperture section (120*b*), said primary aperture (124*a*) configured to allow a first conducting cable (52) having a first diameter to pass therethrough and said coupling tabs (126*b*) configured to facilitate mounting of said removable aperture section (122*b*) over a secondary aperture (128*b*) positioned on said cover body (110*b*);

wherein the secondary aperture (128*b*) is configured to be revealed when said removable aperture section (122*b*) is removed from said cover body (110*b*), said secondary aperture (128*a*) configured to allow a second conducting cable (54) having a second diameter that is greater than the first diameter of the first conducting cable (52) to pass therethrough.

5. The finger safe cover (100*b*) as claimed in claim 4, wherein said coupling tabs (126*b*) are configured to snap fit onto a portion of the cover body that surrounds said secondary aperture (128*b*).

6. The finger safe cover (100*b*) as claimed in claim 4, wherein said cover body (110*b*) comprises a front plate, a bottom plate and two side plates, wherein the removable aperture section (120*b*) is located on said front plate and the fitment of said finger safe cover (100*b*) on the housing of the electrical switching device (50) is facilitated through said side plates and said bottom plate.

7. The finger safe cover (100*b*) as claimed in claim 4, wherein said finger safe cover (100*b*) has a pair of ears (140*b*) configured to allow snap-fitment of said finger safe cover (100*b*) on the housing of said electrical switching component (50).

8. The finger safe cover (100*b*) as claimed in claim 4, wherein said finger safe cover (100*b*) is adapted to be fitted between said terminal and an explosion-proof enclosure.

9. The finger safe cover (100*b*) as claimed in claim 4, wherein said finger safe cover (100*b*) is made of an insulating transparent material.

10. The finger safe cover (100*a*) as claimed in claim 1, wherein the primary aperture of the removable aperture section is positioned within the secondary aperture.

11. The finger safe cover (100*b*) as claimed in claim 4, wherein the primary aperture on the removable aperture section is positioned within the secondary aperture of the cover body.

12. A finger safe cover (100*a*) for a terminal of an electrical switching component (50), said finger safe cover (100*a*) comprising a cover body (110*a*) with an expandable aperture section (120*a*), said expandable aperture section (120*a*) located on said cover body (110*a*) to allow a conducting cable to pass therethrough and make electrical contact with said terminal, said expandable aperture section (120*a*) having:

a removable aperture section (122*a*) having a primary aperture (124*a*) that allows a first conducting cable (52) having a first diameter to pass through the primary aperture (124*a*) of the removable aperture section (122*a*), a frangible coupling section (126*a*) extending from an outer periphery of said removable aperture section (122*a*), said frangible coupling section (126*a*) configured to couple said removable aperture section (122*a*) to said cover body (110*a*), a secondary aperture (128*a*) positioned in the cover body (110*a*) configured to be revealed when said removable aperture section (122*a*) is detached and removed from said cover body (110*a*) by breaking said frangible coupling section (126*a*), said secondary aperture (128*a*) configured to allow a second conducting cable (54) having a second diameter that is greater than the first diameter of the first conducting cable (52) to pass therethrough, wherein the removable aperture section has a square shape.

13. The finger safe cover of claim 12, wherein the primary aperture has a square shape.

14. The finger safe cover of claim 12, wherein the primary aperture has a round shape.

15. The finger safe cover of claim 1, wherein the secondary aperture has a round shape.

16. The finger safe cover of claim 12, wherein the secondary aperture has a square shape.

17. The finger safe cover (100*a*) as claimed in claim 1, wherein said cover body (110*a*) comprises a front plate, a bottom plate and two side plates, wherein the expandable aperture section (120*a*) is located on said front plate and the fitment of said finger safe cover (100*a*) on the housing of the electrical switching device (50) is facilitated through said side plates and said bottom plate.

18. The finger safe cover (100*a*) as claimed in claim 1, wherein said finger safe cover (100*a*) has a pair of ears (140*a*) configured to allow snap-fitment of said finger safe cover (100*a*) on the housing of said electrical switching component (50).

* * * * *